United States Patent [19]

Wiggen et al.

[11] Patent Number: 5,052,326

[45] Date of Patent: Oct. 1, 1991

[54] DETACHABLE BOAT ARCH

[76] Inventors: Brian L. Wiggen, 1331 Springwood, Fort Collins, Colo. 80525; Jerry E. Jaycox, 709 Nyssa, Loveland, Colo. 80538

[21] Appl. No.: 531,912

[22] Filed: Jun. 1, 1990

[51] Int. Cl.[5] ..... B63B 17/00

[52] U.S. Cl. ..... 114/343; 114/364; 403/353

[58] Field of Search ..... 114/343, 361, 364, 203; 403/353; 248/222.1, 503, 681

[56] References Cited

U.S. PATENT DOCUMENTS 1,801,354 4/1931 Lindburg ..... 248/681
2,829,660 4/1958 Wester et al. ..... 114/361 X
4,742,795 5/1988 DePrey et al. ..... 114/343 X

FOREIGN PATENT DOCUMENTS 1520891 8/1978 United Kingdom ..... 403/353

*Primary Examiner*—Sherman Basinger
*Attorney, Agent, or Firm*—Dean P. Edmundson

[57] ABSTRACT

A supporting arch system is described which can be detachably mounted on a marine craft. The arch is useful for supporting various equipment, such as antennas for radar and radio system. The arch is detachably fastened to mounting plates fastened to the gunwales of the craft. A horizontal cross-member extends between two upright members. Cross-members of different lengths can be used when mounting the arch on marine craft of different widths.

8 Claims, 4 Drawing Sheets

DETACHABLE BOAT ARCH

FIELD OF THE INVENTION

This invention relates to arch systems for marine craft. More particularly, this invention relates to arch systems for attachment to a marine craft for supporting various equipment, such as electronic equipment (e.g., antennas for radar and radios).

BACKGROUND OF THE INVENTION

Arches of fixed shape, size and design have been available for a long period of time for mounting on marine craft. Typically, one side of the arch is secured to the gunwale on one side of the craft and the other side of the arch is secured to the gunwale on the opposite side of the craft. The size and design of the arch corresponds to the width and design of the marine craft so that the arch can be installed properly.

Various types of equipment are installed on or fastened to an arch system, such as antennas, lights, horns, etc. Sometimes the arch system serves only a decorative or aesthetic function on the craft.

There has not heretofore been provided an arch system which is readily detachable and which can be quickly and easily assembled and fastened to marine craft. Prior arch systems have been semi-permanently attached to marine craft by means of large bolts protruding through the bottom of the arch into the gunnels. Plates and nuts may be used to secure the bolts. Removal of such an arch system is very time consuming and would leave a number of large openings in each gunnel. Such arch system cannot be removed easily in order to attach a standard boat cover, for example. Furthermore, such prior arch system does not include a removable center section. Accordingly, such arch system cannot easily be attached to boats of different sizes.

SUMMARY OF THE PRESENT INVENTION

In accordance with the present invention there is provided an arch system which can be detachably secured to a marine craft of the type including gunwales on opposite sides or other such supporting structure. The arch system comprises:

(a) first and second mounting plate members which are to be secured to the gunwales or opposite sides of the craft;

(b) first and second elongated upright members each having upper and lower ends; wherein the lower end of said first upright member is detachably secured to said first mounting plate member; and wherein said lower end of said second upright member is detachably secured to said second mounting plate member; and (c) a horizontally disposed cross-member having first and second ends, wherein said cross-member is detachably secured to said upper ends of said first and second upright members.

The arch system can be readily attached or detached from the craft, and it can also be collapsed for easy storage. The length and design of the cross-member may be varied, as desired, so that the arch system can be used on marine craft of different sizes. Various types of equipment and apparatus can be mounted on or carried by the arch.

The arch system can be attached or detached very quickly and easily without the use of tools. One person can perform the task. Because the arch is collapsible, it can be readily stored when not in use. It may even be stored on the marine craft itself. There is no need to have a custom boat cover made to accommodate the arch.

Other advantages of the arch system of this invention will be apparent from the following detailed description.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
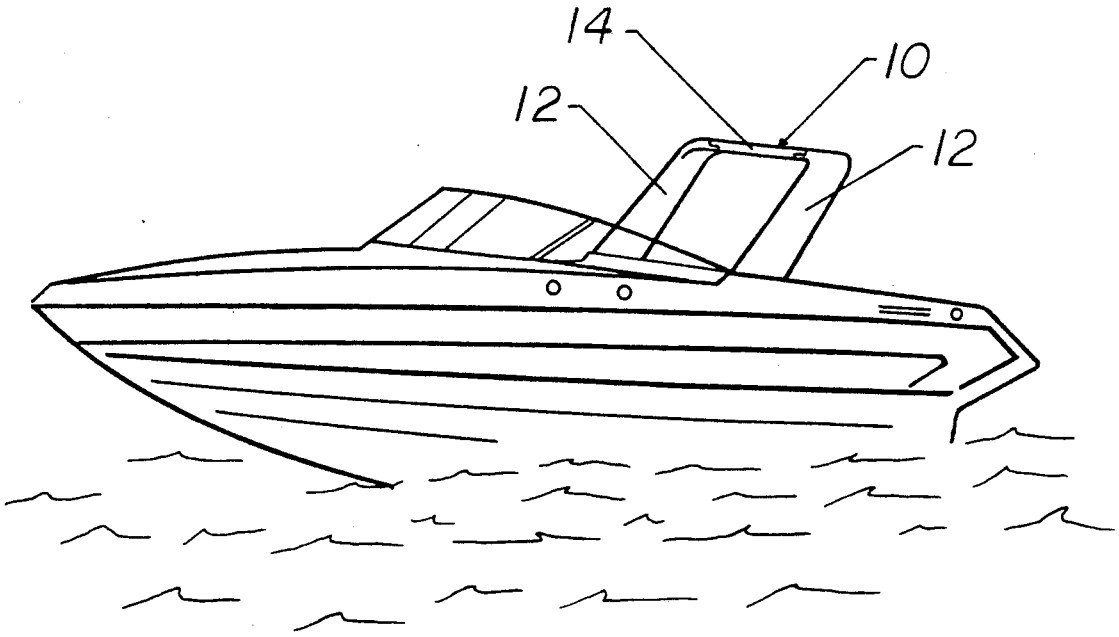
FIG. 1 is a perspective view illustrating an arch system of the invention detachably secured to the gunwales of a marine craft.
Figure 2:
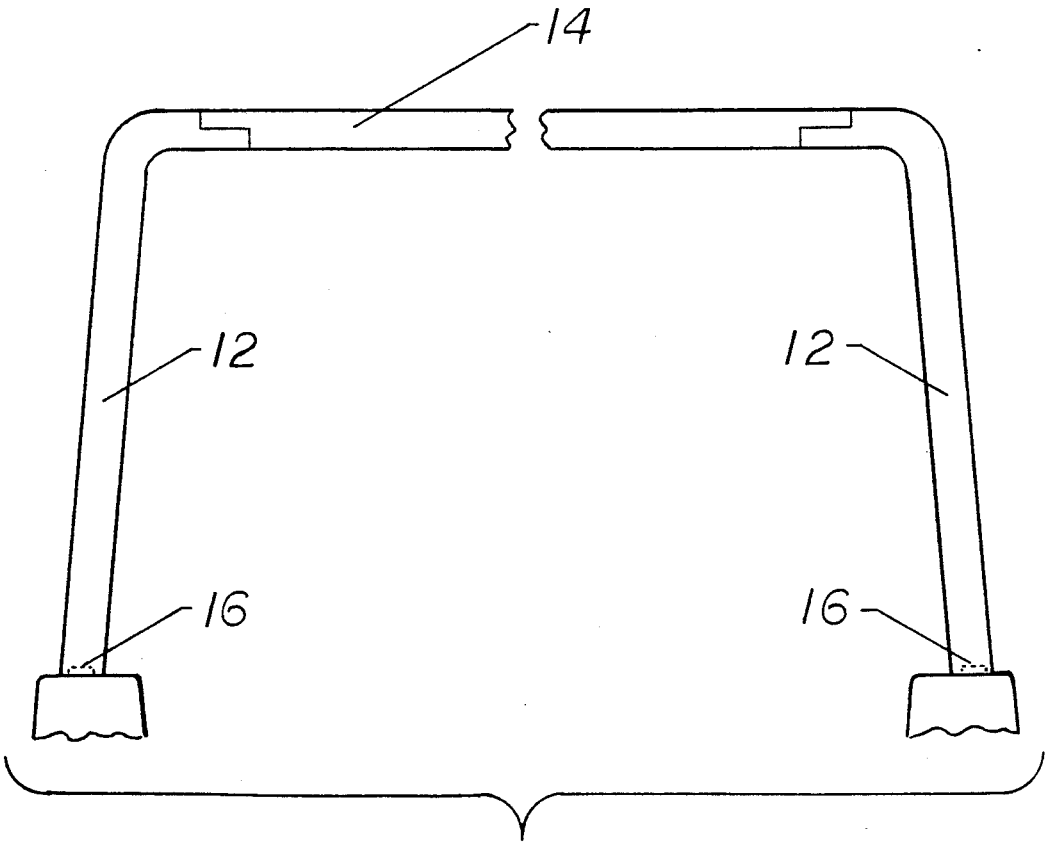
FIG. 2 is a rear elevational view of the arch system of FIG. 1.

In the drawings there is illustrated one embodiment of arch system 10 of the invention for mounting on the gunwales or rear deck of a marine craft. The arch system includes spaced-apart upright members 12 and horizontal cross-member 14 connected between the upper ends of the uprights 12. The lower end of each upright member 12 is detachably secured to a mounting plate 16 which is fastened to the gunwale or other suitable support structure of the boat or marine craft.

Figure 3:
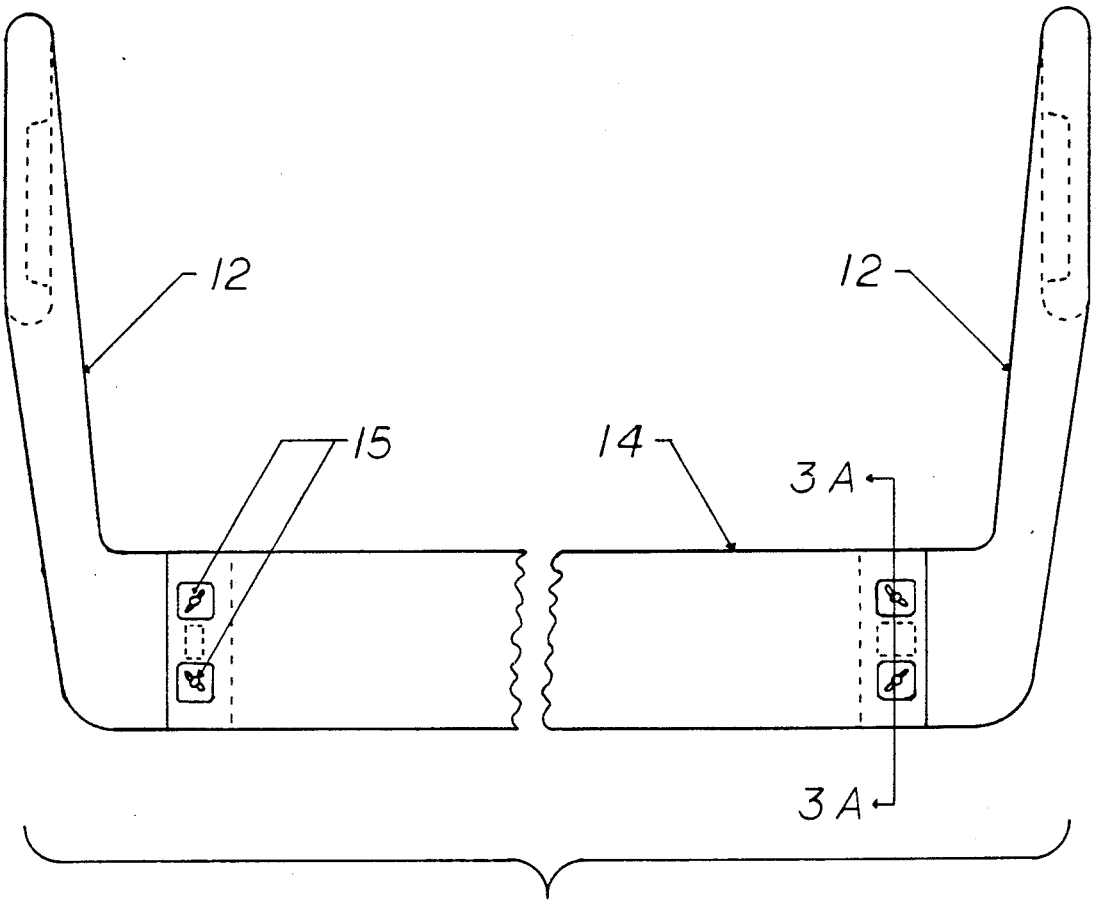
FIG. 3 is a top view of the arch system of FIG. 1.
Figure 3A:
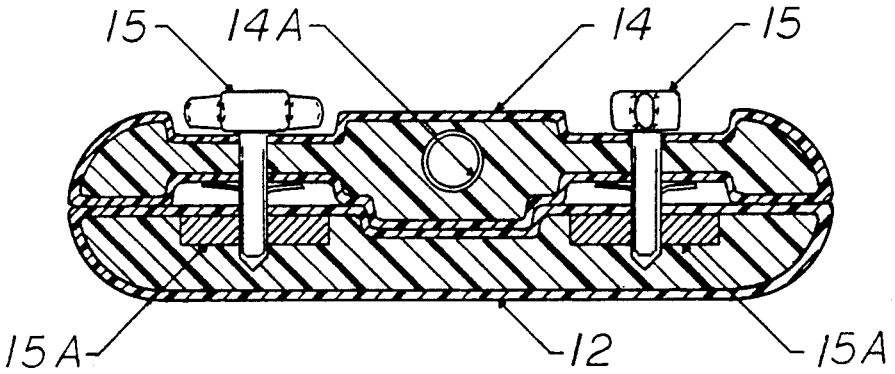
FIG. 3A is a cross-sectional view taken along line 3A—3A in FIG. 3.

The cross-member 14 is preferably attached or connected at each of its ends to one of the upright members in a manner such that it can be easily disconnected or detached when it is desired to detach the arch system from the craft. A preferred system for attaching the ends of the cross-member to the uprights involves the use of a plurality of bolts (preferably having tabs or the like secured to the heads so that no tools are required in order to tighten and loosen them). This is illustrated in FIGS. 3 and 3A.

Preferably the ends of cross-member 14 overlap a portion of each upright member 12, as illustrated. Wing bolts 15 are threaded and are adapted to threadably engage threaded aluminum plates 15A carried by each upright member 12. Because the bolts 15 include wings or tabs, the bolts can be tightened and loosened very quickly and readily without the use of tools. This feature enables the cross-member to be attached or detached simply and easily, as needed. When the bolts 15 are tightened, the cross-member is held in place very securely.

The length of the cross-member may vary, as desired, in order to accommodate mounting of the arch system on marine craft of different widths. The shape and design of the cross-member, and also of the upright members, may vary as desired. The height of the upright members may also vary as desired.

Figure 4:
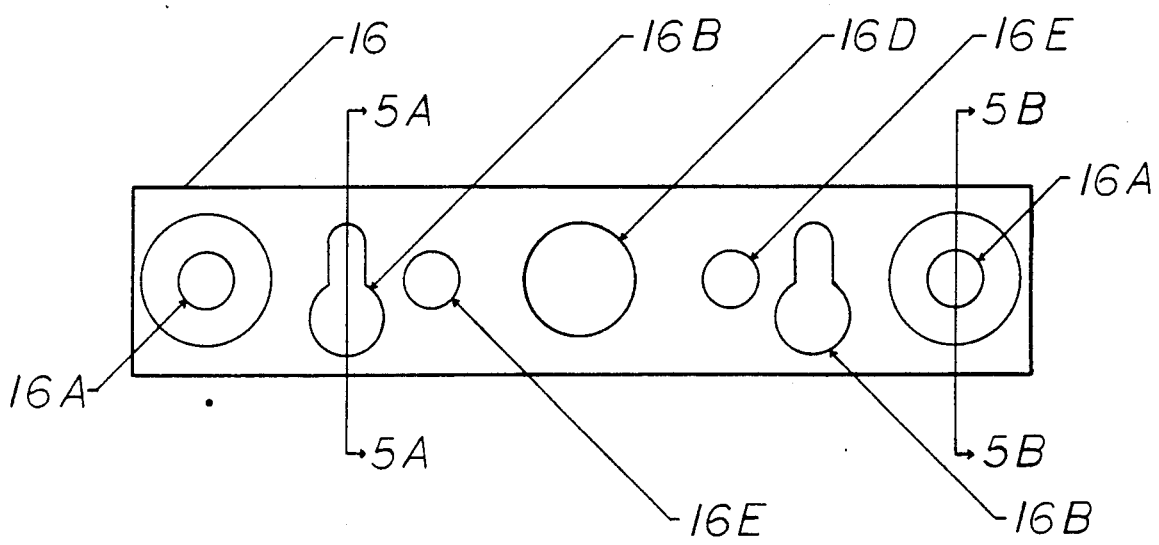
FIG. 4 is a top view of one embodiment of mounting plate which is useful in the present invention.
Figure 5A:
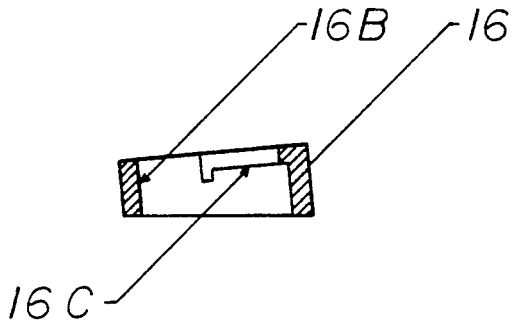
FIG. 5A is a cross-sectional view of the mounting plate of FIG. 4 taken along line 5A—5A.
Figure 5B:
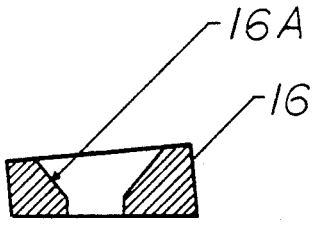
FIG. 5B is a cross-sectional view taken along line 5B—5B.

The preferred embodiment of mounting plate 16 which is useful in the present invention is illustrated in FIGS. 4 and 5. The mounting plate is normally secured to the gunwale or other support structure of the marine craft by means of screws or bolts which extend through apertures 16A in the mounting plate and into the structure of the marine craft. The mounting plate includes one or more keyhole-shaped openings 16B which are adapted to receive the head of a bolt carried by the catch means or attachment means fastened to the lower end of each upright member. The head of the bolt can then be captured in recessed area 16C in the narrowed portion of the keyhole slot. The mounting plate may also include an opening 16D for accommodating electrical wires or control cables extending from the structure of the marine craft to a component or device mounted on the arch system. Preferably there is a corresponding conduit or passageway 12A extending through the length of each upright support member and also a passageway 14A through the length of the cross-member. Openings 16E may be used for alignment purposes when the lower ends of the upright members include alignment pins.

Figure 6:
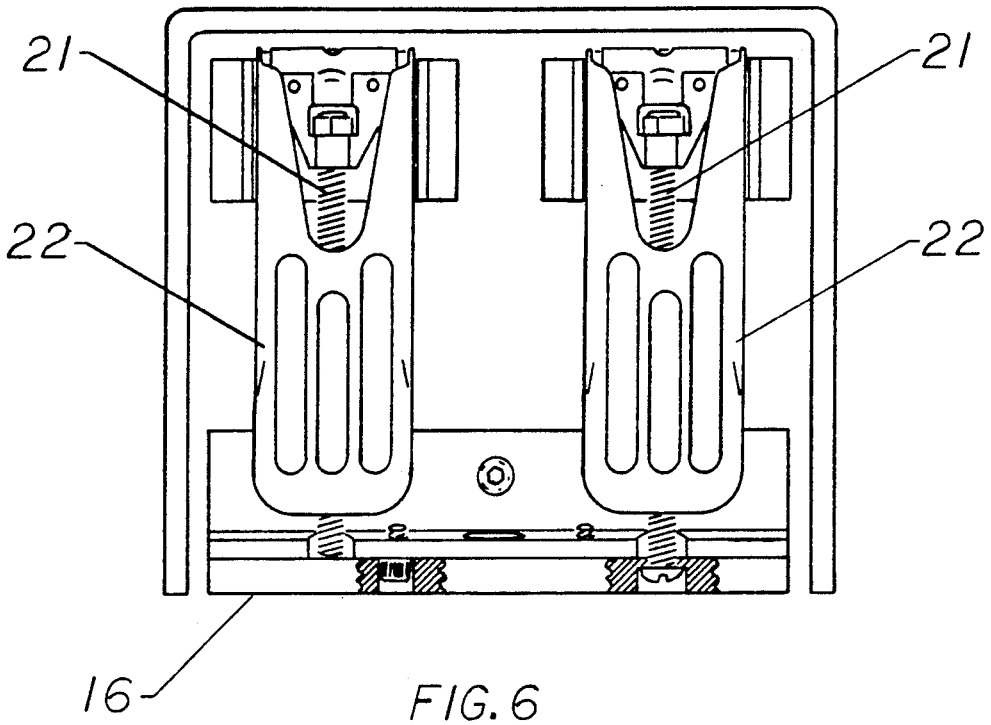
FIG. 6 is a front elevational view illustrating one embodiment of attachment means which is useful in this invention.
Figure 7:
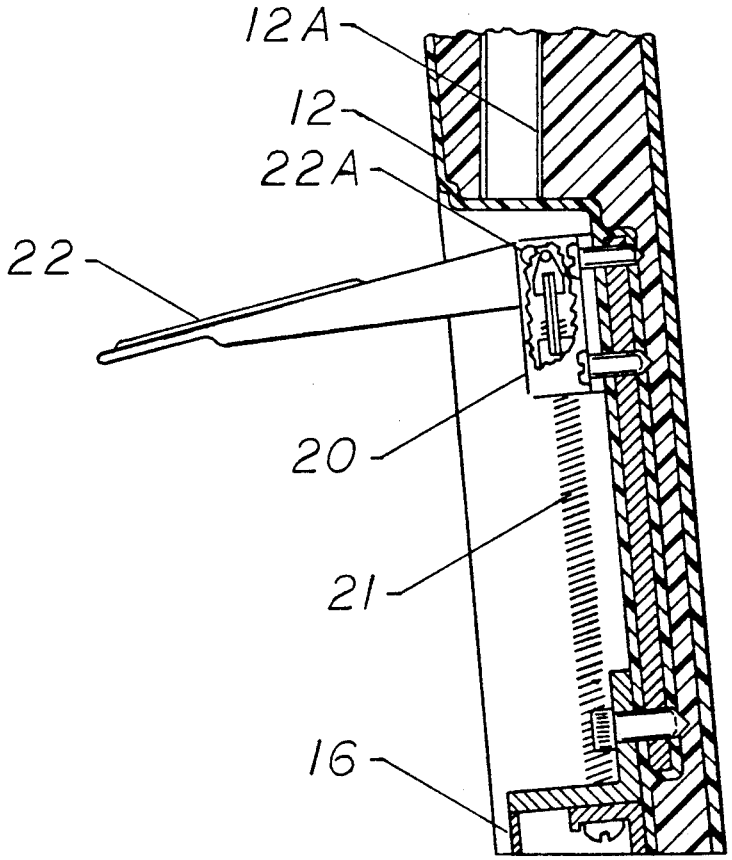
FIG. 7 is a side elevational view (partially cut-away) illustrating the attachment means of FIG. 6.

As illustrated in FIGS. 6 and 7, the lower end of each upright support is detachably secured to a mounting plate 16 by means of attachment means 20 comprising an elongated draw bolt 21 and lever arm 22. The upper end of bolt 21 is attached to the upper end of lever arm 22. The upper end of arm 22 is also pivotably mounted (by pin 22A) to the upright support in a manner such that the lever arm 22 is movable between upper and lower positions. When the lever arm 22 is in its upper position, the bolt 21 is moved to a lowered position where it can be engaged in a keyhole opening in the mounting plate. When the lever arm 22 is moved to its lower position, it causes bolt 21 to be raised. This causes the upright member 12 to be drawn downwardly. In this manner the upright member 12 becomes securely attached to the mounting plate 16.

No tools are required in order to fasten the upright member to the mounting plate. Similarly, no tools are required in order to detach the upright member from the mounting plate.

Preferably there are two such attachment means carried by the lower end of each upright member. There could be more, or fewer, of such attachment means if desired. Other types of attachment means could be used instead of the type illustrated in the drawings. It is highly preferred to be able to detach the upright members quickly and without the use of tools. The attachment means can be recessed into the lower end of each upright member. Preferably a removable door or access opening covers the attachment means.

Each of the three separate components or sections of the arch system is separately formed. Preferably each component comprises a rigid polyurethane foam core encased in a fiberglass-reinforced shell of polyester resin. It may be finished with a polyester gel coat.

The molding is done using a resin transfer molding process. The molds used are of composite construction, consisting of a surface coat of polyester tooling gel, a facing laminate of multiple layers of glass fiber incorporating a core layer of balsa wood. Between the balsa core and the facing layer a series of copper cooling tubes are bonded to the laminate to prevent overheating of the tool and the part.

The balsa core is used to add strength and rigidity to the tool to help avoid stress to sharp corners in the tool under injection pressures and to maintain dimensional stability. The mold must be sufficiently rigid to be able to withstand internal pressures of 50–100 psi during the injection process.

Structural reinforcement must be added to the facing laminate. This is done by laminating balsa ribs onto the back of the facing layer along the perimeter and across the center.

During construction of the mold, locating dowels are laminated in for proper alignment of the part to ensure a clean seam line on the part.

Upon completion of both halves of the production mold, the part cavity is lined with sheet wax to simulate the thickness of the skin which the molded component will have.

Once the foregoing is completed, a fiberglass master shell is laminated in the cavity to simulate the dimensions of the foam core. The master is removed and a mold for the foam core is then produced from this master.

To produce each component part of the arch each foam core is loaded with its aluminum reinforcing plates wrapped in fiberglass. Then the entire foam core is wrapped in glass fiber and placed in the mold cavity which has already been sprayed with gel coat. Then the mold is closed.

The mold is clamped or pressed shut and resin is pumped into the cavity through a fill tube positioned in the mold in a position to ensure proper filling. Resin is pumped into the mold until it appears at the vent ports. The resin is allowed to reach a stable cure, then the mold is opened and the part removed.

Other techniques may be used to produce component parts for the arch system, if desired. The parts should be rigid, self-supporting, and dimensionally stable. As previously stated, they may be made in any desired sizes and in any desired shape.

The arch system of this invention can be assembled on a marine craft in approximately 90 seconds. It can be easily disassembled in a similar amount of time. A variety of accessories can be mounted on the arch (e.g., stereo speakers, running lights, horns, antennas, etc.).

The assembled arch system on the marine craft appears as an integral part of the craft and appears permanent. it can also be readily detached, turned around, and then remounted so that it projects forwardly instead of rearwardly on the craft.

Other variants are possible without departing from the scope of this invention.

What is claimed is:

1. An upwardly extending supporting arch system which is detachably attachable to a marine craft of the type including first and second gunwales on opposite sides of said craft, said arch system comprising:

(a) first and second mounting plate members which are to be secured to the gunwales or opposite sides of the craft;

(b) first and second elongated upright members each having upper and lower ends; wherein the lower end of said first upright member is detachably secured to said first mounting plate member; and wherein said lower end of said second upright member is detachably secured to said second mounting plate member; and (c) a horizontally disposed cross-member having first and second ends, wherein said cross-member is detachably secured to said upper ends of said first and second upright members; and (d) first attachment means carried by said lower end of said first upright member, and second attachment means carried by said lower end of said second upright member; wherein said first an second attachment means are adapted to detachably secure said lower ends of said first and second upright members to said first and second mounting plate members, respectively;

wherein each said attachment means comprises (1) a lever arm having first and second ends, wherein said first end is pivotably secured to said lower end of one said upright member, and (2) a draw bolt having upper and lower ends, wherein said upper end of said draw bolt is attached to said first end of said lever arm; wherein said lever arm is pivotable between first and second positions to move said draw bolt between upper and lower positions; and wherein said lower end of said draw bolt is adapted to engage a said mounting plate member.

2. An arch system in accordance with claim 1, wherein said mounting plate member includes at least one keyhole slot for receiving said lower end of said draw bolt.

3. An arch system in accordance with claim 1, wherein there are two said attachment means carried by each said upright member.

4. An arch system in accordance with claim 1, wherein said cross-member is detachably secured to said upright members by means of threaded bolts.

5. In a marine craft of the type including first and second gunwales on opposite sides of said craft, the improvement which comprises an upwardly extending supporting arch system which can be detachably secured to said craft, wherein said arch system comprises:

(a) first and second mounting plate members secured to said first and second gunwales, respectively:

(b) first and second elongated upright members each having upper and lower ends; wherein the lower end of said first upright member si detachably secured to said first mounting plate member; and wherein said lower end of said second upright member is detachably secured to said second mounting plate member; and (c) a horizontally disposed cross-member having first and second ends, wherein said cross-member is detachably secured to said upper ends of said first and second upright members; and (d) first attachment means carried by said lower end of said first upright member, and second attachment means carried by said lower end of said second upright member; wherein said first and second attachment means are adapted to detachably secure said lower ends of said first and second upright members to said first and second mounting plate members, respectively;

wherein each said attachment means comprises (1) a lever arm having first and second ends, wherein said first end is pivotably secured to said lower end of one said upright member, and (2) a draw bolt having upper and lower ends, wherein said upper end of said draw bolt is attached to said first end of said lever arm; wherein said lever arm is pivotable between first and second positions to move said draw bolt between upper and lower positions; and wherein said lower end of said draw bolt is adapted to engage a said mounting plate member.

6. The improvement in accordance with claim 5, wherein said mounting plate member includes at least one keyhole slot for receiving said lower end of said draw bolt.

7. An arch system in accordance with claim 5, wherein there are two said attachment means carried by each said upright member.

8. The improvement in accordance with claim 5, wherein said cross-member is detachably secured to said upright members by means of threaded bolts.

* * * * *